United States Patent [19]

Jones et al.

[11] 4,364,145

[45] Dec. 21, 1982

[54] SCRAPING TOOL

[76] Inventors: John F. Jones; Catherine C. Jones, both of Rte. 6, Box 1054, Brooksville, Fla. 33512

[21] Appl. No.: 224,489

[22] Filed: Jan. 12, 1981

[51] Int. Cl.[3] ..... A47L 1/06

[52] U.S. Cl. ..... 15/236 R; 15/104 S

[58] Field of Search ..... 15/104 S, 236, 235.4

[56] References Cited

U.S. PATENT DOCUMENTS

| | | | |
|---|---|---|---|
| 1,198,257 | 9/1916 | Morrison | 15/236 R |
| 1,490,766 | 4/1924 | Camden | 15/236 R |
| 2,147,458 | 2/1939 | Rohland | 15/104 S |
| 2,275,713 | 3/1942 | Ahlborg | 15/236 R X |
| 2,752,623 | 7/1956 | Tupper | 15/236 R X |
| 3,566,430 | 3/1971 | Young | 15/236 |
| 3,855,846 | 12/1974 | Forget et al. | 15/236 R X |
| 4,086,678 | 5/1978 | Torr | 15/105 |
| 4,121,316 | 10/1978 | Perry | 15/236 R |

*Primary Examiner*—Robert L. Bleutge

*Attorney, Agent, or Firm*—Oltman and Flynn

[57] ABSTRACT

The present scraper has a flat base and solid V-shaped scraping elements on the bottom of the base which are elongated parallel to each other in uninterrupted fashion continuously between opposite convex edges of the base. Extending up from the base is a handle which is T-shaped in cross-section perpendicular to direction of elongation of the scraping elements.

2 Claims, 5 Drawing Figures

SCRAPING TOOL

SUMMARY OF THE INVENTION

This invention relates to a scraping tool.

One of the less enjoyable experiences encountered by vehicle drivers in Florida is the "love bug" phenomenon, in which a male insect and a considerably larger female insect fly in tandem, seemingly oblivious to the cars and trucks against which they impinge two-by-two in distressingly large numbers at certain times of the year. After a relatively few miles of driving, a vehicle's windshield, front bumper and front of hood can be virtually covered with dead love bugs. They sometimes clog the vehicle's radiator and cause the engine to overheat. They are extremely difficult to remove from the vehicle surfaces against which they splatter.

The present invention is directed to a hand-held scraper for removing the remains of love bugs or other insects from the windshield and other exposed parts of a vehicle.

A principal object of this invention is to provide a novel and improved scraper which may be conveniently held in a person's hand while being used to scrape the remains of insects and other debris from exposed parts of a car or truck, particularly the windshield.

In accordance with the presently preferred embodiment of the invention, the scraper has a flat base with a pair of convexly curved opposite end edges, a plurality of spaced, parallel, inverted V-shaped scraping elements below the base which are elongated and continuous from one of these convex sides to the opposite convex side of the base, and a handle extending up from the base and having a substantially T-shaped cross-section perpendicular to the length of the scraping elements.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

In the illustrated embodiment, the present scraper has a flat, relatively thin base 10 having straight, parallel front and back edges 11 and 12 and convex opposite end edges 13 and 14.

Figure 1:
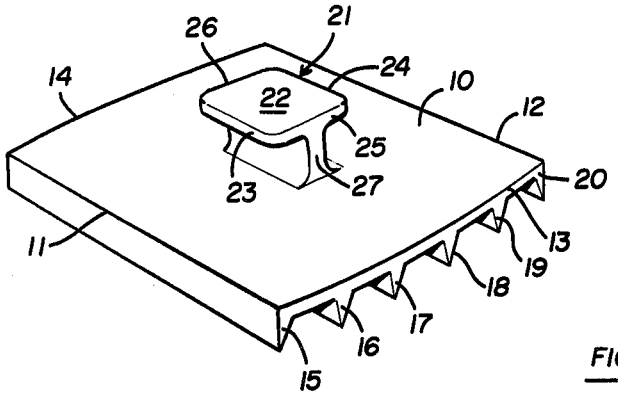
FIG. 1 is a top perspective view of the present scraping tool.
Figure 2:
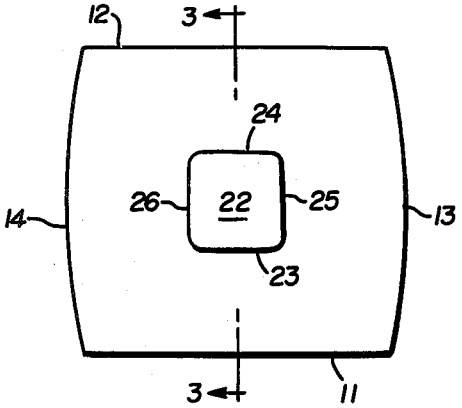
FIG. 2 is a top plan view.
Figure 3:
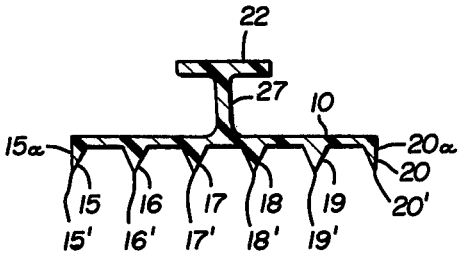
FIG. 3 is a cross-section taken along line 3—3 in FIG. 2.
Figure 4:
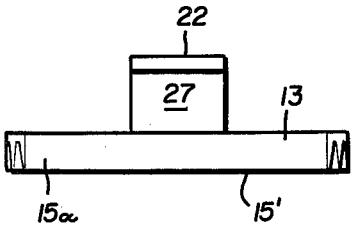
FIG. 4 is an elevational view of the scraping tool taken perpendicular to section line 3—3 in FIG. 2.
Figure 5:
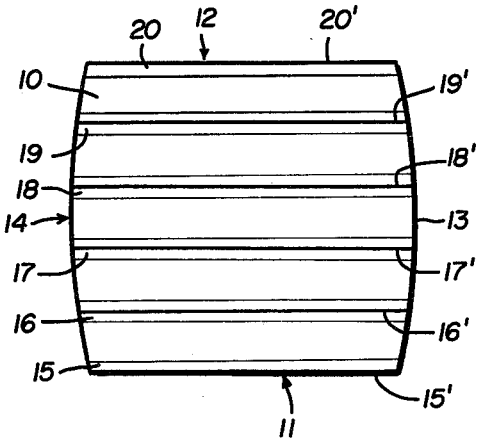
FIG. 5 is a bottom plan view.

A plurality of spaced, parallel scraping elements, here shown as six elements 15, 16, 17, 18, 19 and 20, extend down from the base. Preferably as shown in FIG. 3, the scraping elements are V-shaped and solid in cross-section, with the inwardly positioned elements 16, 17, 18, and 19 having oppositely inclined faces, and with the front and back elements 15 and 20 having front and back faces **15*a* and 20*a* respectively which extend perpendicular to the base 10. The scraping elements terminate at their lower ends in coplanar pointed edges 15', 16', 17', 18', 19' and 20', respectively. As best seen in FIG. 5, the scraping elements 15–20 are elongated parallel to the front and back edges 11 and 12 of the base and they extend continuously without interruption from the one convex end edge 13 to the opposite convex end edge 14**.

A handle 21 extends up from the base 10 at the center. This handle has a thin, flat, outer segment 22 which is generally square in outline and with rounded corners, presenting front and back edges 23 and 24 which extend parallel to the front and back edges 11 and 12 of the base 10 of the tool, and opposite end edges 25 and 26 which extend perpendicular to the front and back edges 23 and 24. A rigid web 27 joins the outer segment 22 of the handle to the base 10 and maintains the outer handle segment 22 parallel to the base. This connecting web 27 extends continuously along the outer handle segment 22 between its opposite end edges 25 and 26. The web 27 is located midway between the front and back edges 23 and 24 of the outer handle segment 22 and it extends perpendicular to the base 10 of the scraper and to the outer segment 22 of the handle. Consequently, the handle 21 has a T-shaped cross-section in a plane perpendicular to the direction of elongation of the V-shaped scraping elements 15–20 which extend down from the base 10.

Preferably, the base 10, scraping elements 15–20 and handle 21 are molded in one piece as an integral unit out of suitable plastic material which imparts a limited degree of flexibility and resilience to the base, scraping elements and handle.

The orientation of the T-shaped handle 21 with respect to the scraping elements 15–20 is such that the user may hold the handle with his fingers extending across the outer segment 22 and the finger tips between the outer segment and the base 10 at one side of the handle's connecting web 27. This is the ideal position of the hand for up-and-down scraping movement of the tool (with the scraping elements 15–20 extending horizontal ). Alternatively, the user may insert his index finger between the outer handle segment 20 and the base 10 on one side of the connecting web 27 and his next finger between the outer handle segment and the base on the opposite side of the connecting web 27. This is an excellent position for holding the scraper when it is to be moved from side-to-side with the scraping elements 15–20 extending in the up-and-down direction in the plane of the surface being scraped.

The present tool may be used for scraping ice and snow from vehicle windshields, as well as for scraping the remains of insects or other debris.

I claim:

1. A scraping tool having a generally flat, thin, flexible and resilient base, a plurality of flexible and resilient scraping elements extending down from said base and being elongated in spaced, substantially parallel relationship to each other continuously across substantially the full width of the base and terminating in pointed edges at their lower ends, and a handle extending up from the base, said handle being substantially T-shaped in cross-section perpendicular to the direction of elongation of said scraping elements.

2. A scraping tool according to claim 1, wherein said handle comprises a generally flat thin outer segment extending substantially parallel to said base, and a rigid connecting web extending perpendicularly from said outer segment to said base, said connecting web being elongated in the direction of elongation of said scraping elements.

* * * * *